US005800318A

United States Patent [19]

Coviello

[11] Patent Number: 5,800,318

[45] Date of Patent: Sep. 1, 1998

[54] REHABILITATION THRU ATHLETIC TRAINING PRINCIPAL/WALKER TYPE DEVICE

[76] Inventor: Gerald A. Coviello, 152 Stedman st., Chelmsford, Mass. 01824

[21] Appl. No.: 407,588

[22] Filed: Mar. 20, 1995

[51] Int. Cl.[6] ..... A63B 22/20; A61H 3/04

[52] U.S. Cl. ..... 482/68; 135/67

[58] Field of Search ..... 482/66, 68, 69, 482/67; 280/87.02; 224/25 R; 297/35; 135/67, 74

[56] References Cited

U.S. PATENT DOCUMENTS

| | | | |
|---|---|---|---|
| 3,350,095 | 10/1967 | Clasen | 482/68 |
| 4,342,465 | 8/1982 | Stillings | 482/68 |
| 4,985,947 | 1/1991 | Ethridge | 482/68 |
| 5,046,748 | 9/1991 | Oat-Judge | 482/68 |
| 5,058,912 | 10/1991 | Harroun | 482/68 |
| 5,152,730 | 10/1992 | Hoffman | 482/68 |

*Primary Examiner*—Stephen R. Crow

[57] ABSTRACT

A combination athletic trainer/walker for exercising a user's lower body, while giving the user independence of an assistant while walking. The wheeled legs, and attached frame is comprised of heavily padded sides. The frame work is vertically adjustable such that a front bar is positioned at the height of the user's rib cage. The front bar detaches, and is lowered to allow a user to enter and is then attached with a crotch strap between user's legs and reattached. The padded seat is positioned, initially at a standing height and progressively lowered to slightly below a 90 degree angle of a user's knee flexion, when finishing use of the machine. The telescopic horizontal legs are adjusted to an appropriate length to provide muscle strengthening resistance. Adjustment of the vertical legs controls the height of the frame work. Wheels are provided for movement of the frame over a floor, and the two front wheels are of swivel type allowing the user to turn in any direction. The two rear wheels are permanently fixed in a straight position so as to secure the back end from free rotation to the left or right. Brake plate assemblies are provided on all four wheels with the two rear having brake pegs to immobilize the unit when the user is seated.

1 Claim, 5 Drawing Sheets

FRONT VIEW

REHABILITATION THRU ATHLETIC TRAINING PRINCIPAL/WALKER TYPE DEVICE

TECHNICAL FIELD

This invention relates to progressive resistance strength training machines, especialy those relating to the thigh and buttock muscles, to endurance training apparatus (also for the thigh and buttock muscles), both types typical of that which are found in gymnasiums and sports medicine facilities, and to therapeutic walking aids and safety walkers.

BACKGROUND ART

Strength training equipment, known in the prior art, utilize the principle's of progressive resistance training for the thigh and buttock muscles, though usually equipped with a seat, are constructed to offer resistance only to persons capable of contracting these muscles through their full range of motion.

There are some endurance training devices made for leg training that incorporate a principle of disadvantageous leverage similar to this claimed invention. One of the more closely related devices is usualy referred to as a 'sled', and is used mainly by football teams. The 'sled' utilizes a pair of wheelless horizontal legs at ground level projecting several feet out in front of the user who pushes against a vertically erect padded frame attached to the legs. This device has no seat or crotch strap.

It is obvious that none of these devices offer a person the ability to walk, while affording them protection against a fall. And, these devices are obviously not constructed to deal with persons handicapped, recovering from debilitating injuries, or older persons losing their ability to sit, stand, and walk on their own power because of atrophy of the thigh and buttock muscles caused by lack of use.

There are therapeutic walking aids and safety walkers known in the prior art that use wheels, crotch straps, saddles, and seats but all these devices are designed with considerations given mainly to ease of entry, maintaining balance, protection from falling, and walking without the need for an assistant, and/or therapist present. These considerations are addressed only so long as the person continues use of the device, and the device itself becomes a sophisticated safety crutch, or an assistant to the therapist, and for sufficient length of time to incorporate the person into an exercise regimen of sufficient vigor and frequency so as to elicit recovery of the person's mobility.

Therefore, unlike the aforementioned devices, the object of this invention is to substitute the need for a physical therapist and certain other wheel based walking aids by offering a continuous progressive resistance strength and endurance training routine to an individual who has suffered atrophy or damage to the leg and buttock muscles.

DISCLOSURE OF THE INVENTION I

This invention is a strength training device to rehabilitate weak leg muscles by:(1) allowing the user to adjust, a few degrees at a time, the depth of the 'beginning angle' of extension a person must move their legs through in order to stand, and (2) using their legs to walk around by leaning and pushing on the supportive front and/or rear bars. With the seat set at a height equal to almost full standing position, this will be the 'beginning angle' the person will stand from to use their legs to walk around. When the user is able to stand with ease from this initial 'beginning angle', the 'beginning angle' is then set lower (closer to the floor) by adjusting the seat portion only, and this new angle is greater than the last (the knees are bent more), but only by a few degrees. When the user can stand with ease from this new angle, the angle is again set lower (only by a few degrees). The user continues this routine throughout the use of the machine.

When in the standing position, the user leans weight on the front or rear bars, driving forward or backward respectively. The front and rear horizontal legs can keep the device stable when extended to the earliest settings, regardless of the height setting of the framework. The legs can be extended to other settings to offer a greater degree of disadvantageous leverage, making device harder to push, thereby offering rehabilitative exercise beyond what is necessary to move.

As the user repeats these actions, the muscle fibers which move the legs through the range of motion from the starting position to the standing position and all other muscles responsible for walking, will strengthen due to hypertrophy, (via constant use) and also because the nervous system which engages these fibers to contract (the neuro-muscular pathway), will "learn" to engage more muscle fibers, enabling the legs to exert greater force.

This progressive resistance program is followed until the user can stand and walk, from the normal seated position, on their own power.

DISCLOSURE OF THE INVENTION II

The height of the framework is set so that the front bar is level with the individual's rib cage when in the standing position. This is done by adjusting the vertical legs upward or downward. Pulling out or pushing in the horizontal legs gives the device the necessary stability for the respective height.

The height of the seat is set independently of the height of the framework by pulling pins and adjusting seat upward or downward to the height necessary, then by reinserting the pins. This is done to obtain the 'beginning angle' of extension mentioned previously. The 'beginning angle' will differ slightly from person to person based on the individual level of strength in the user's legs. As strength increases the angle is reset to become greater. The user stands from the preset angle and leans on the front or rear bars which will always be at rib cage level.

The user enters the framework by pulling pins and lowering the front bar. Once the user is in the framework and facing front; the front bar is brought back up with the crotch strap positioned between the legs to prevent the user from slipping out and the front bar is reattached to the framework.

When seated, an individual's body weight will push down on the spring loaded pressure sensitive wheel platforms, activating the rear brake pegs, which will keep the device stationary.

DESCRIPTION OF THE INVENTION

Figure 1:
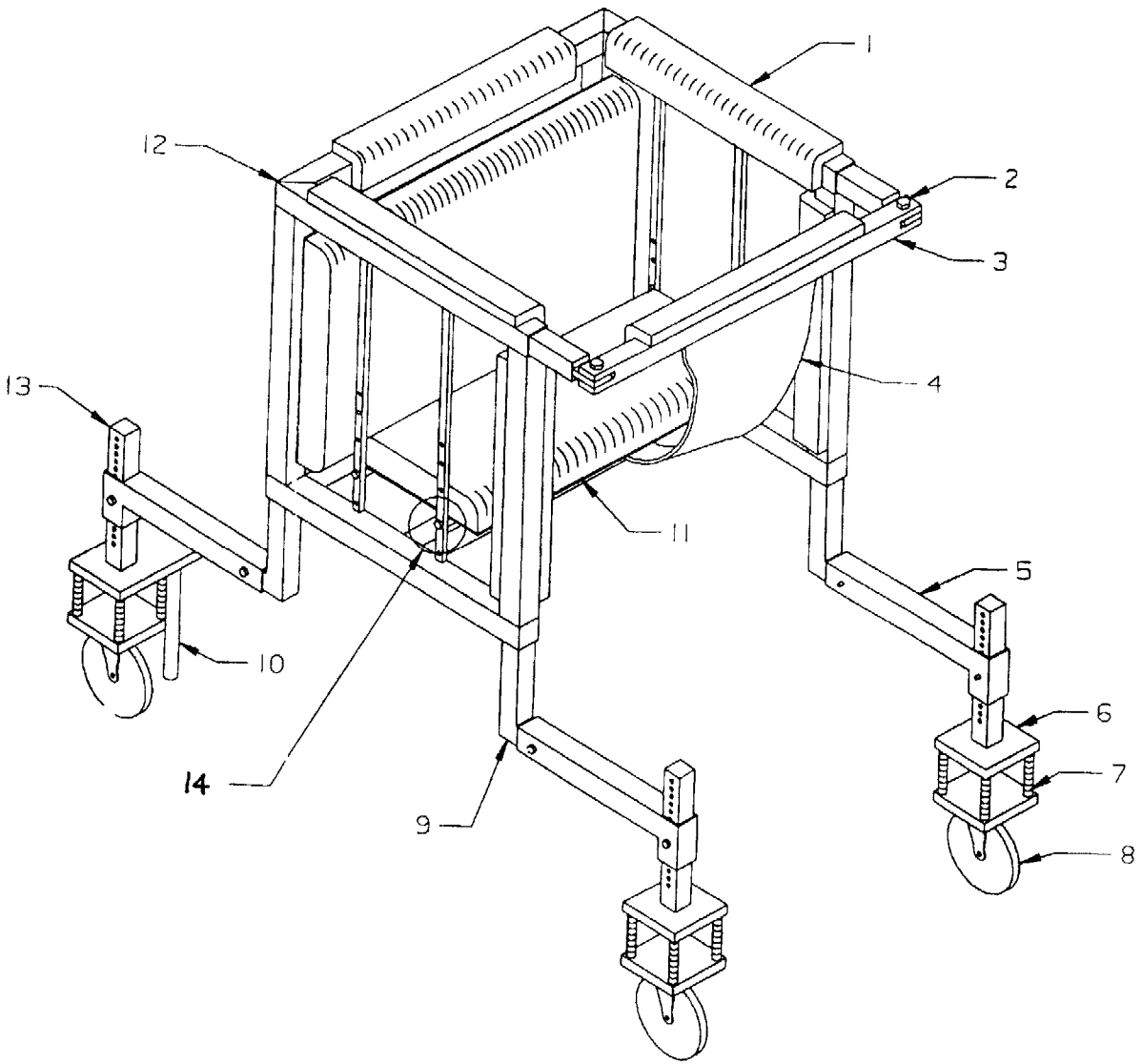
FIG. 1 is an overall Iso view.

Referring now to the drawings; this device is a combination athletic trainer/walker comprising:

A three-sided cage, shown collectively as #12 FIG. 1, with padding shown as #1 FIG. 1 on the top bars of the cage as well as the entire backrest.

A front bar, also padded, and shown as #3 FIG. 1, which attaches to the cage by sliding into tongues of the top side bars (this junction is shown in detail as #11 FIG. 4) and then being secured by pins, shown as #2 FIG. 1.

A crotch strap, shown as #4 FIG. 1, is permanently affixed to the front bar and to the seat.

Figure 2:
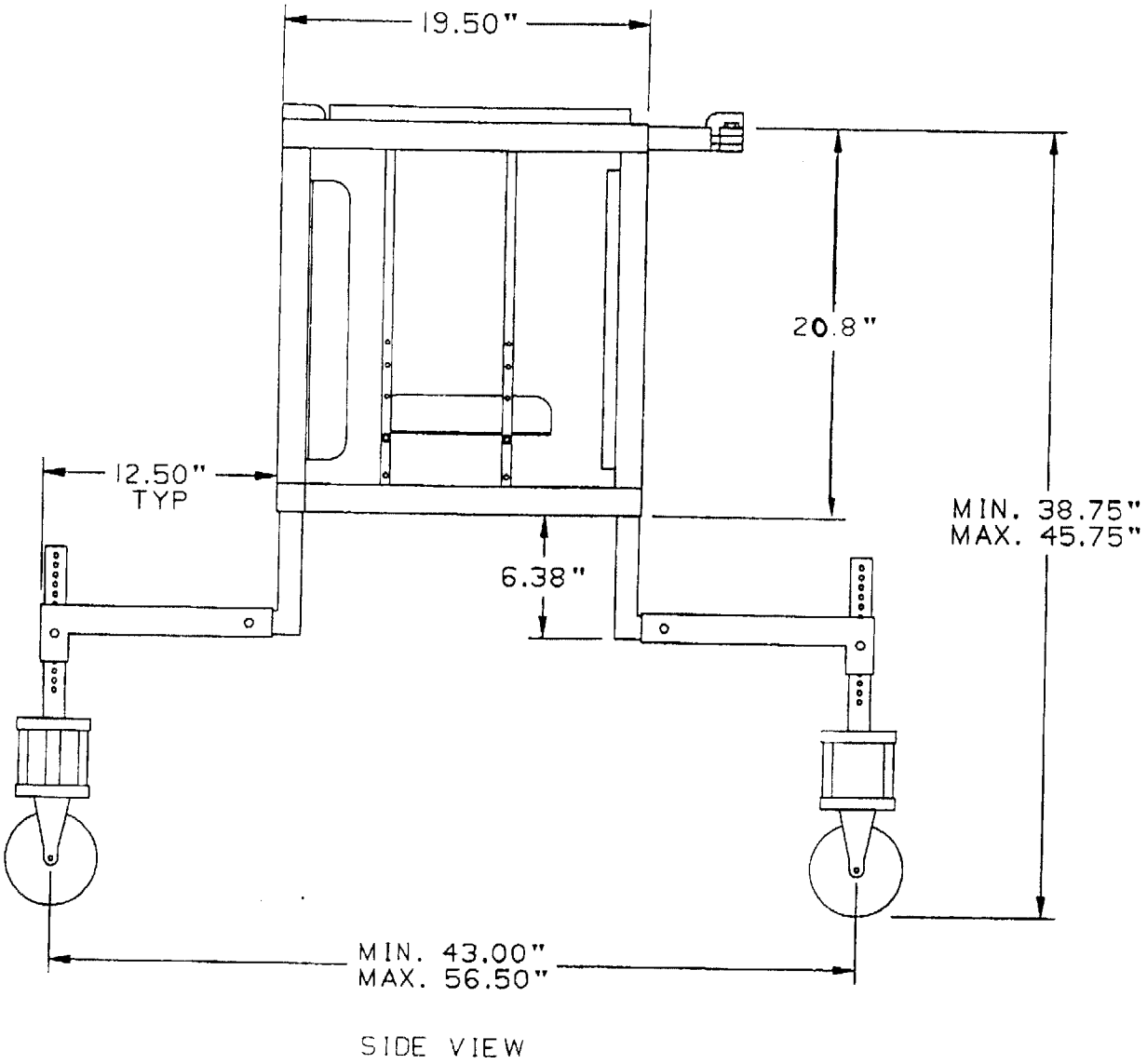
FIG. 2 is a side view.
Figure 3:
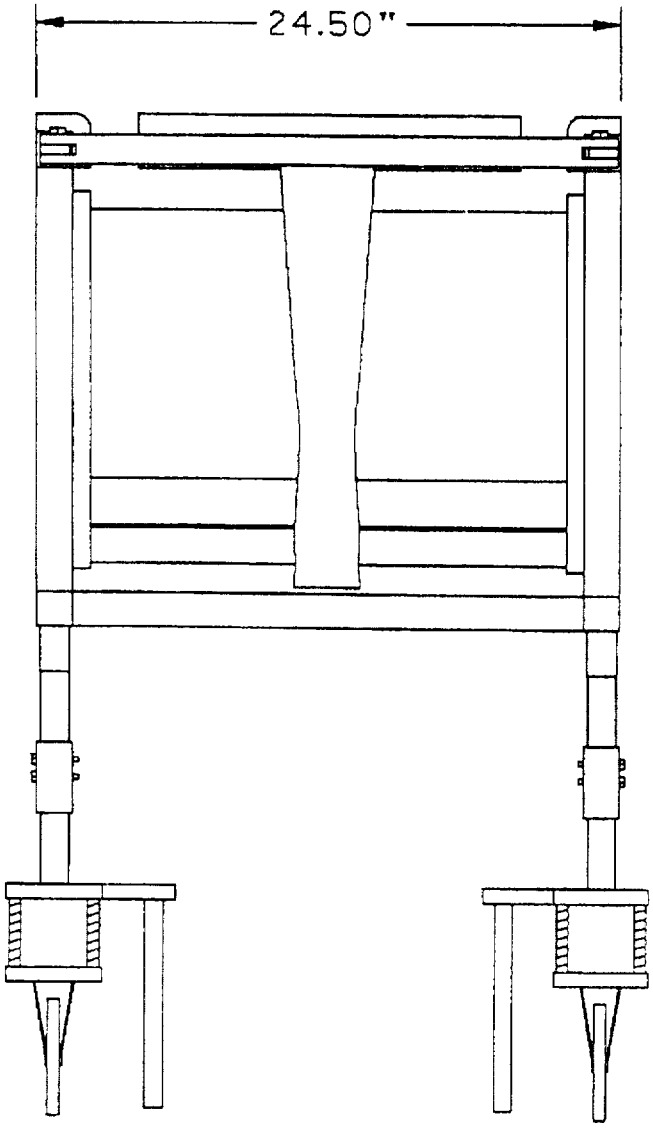
FIG. 3 is a front view.
Figure 4:
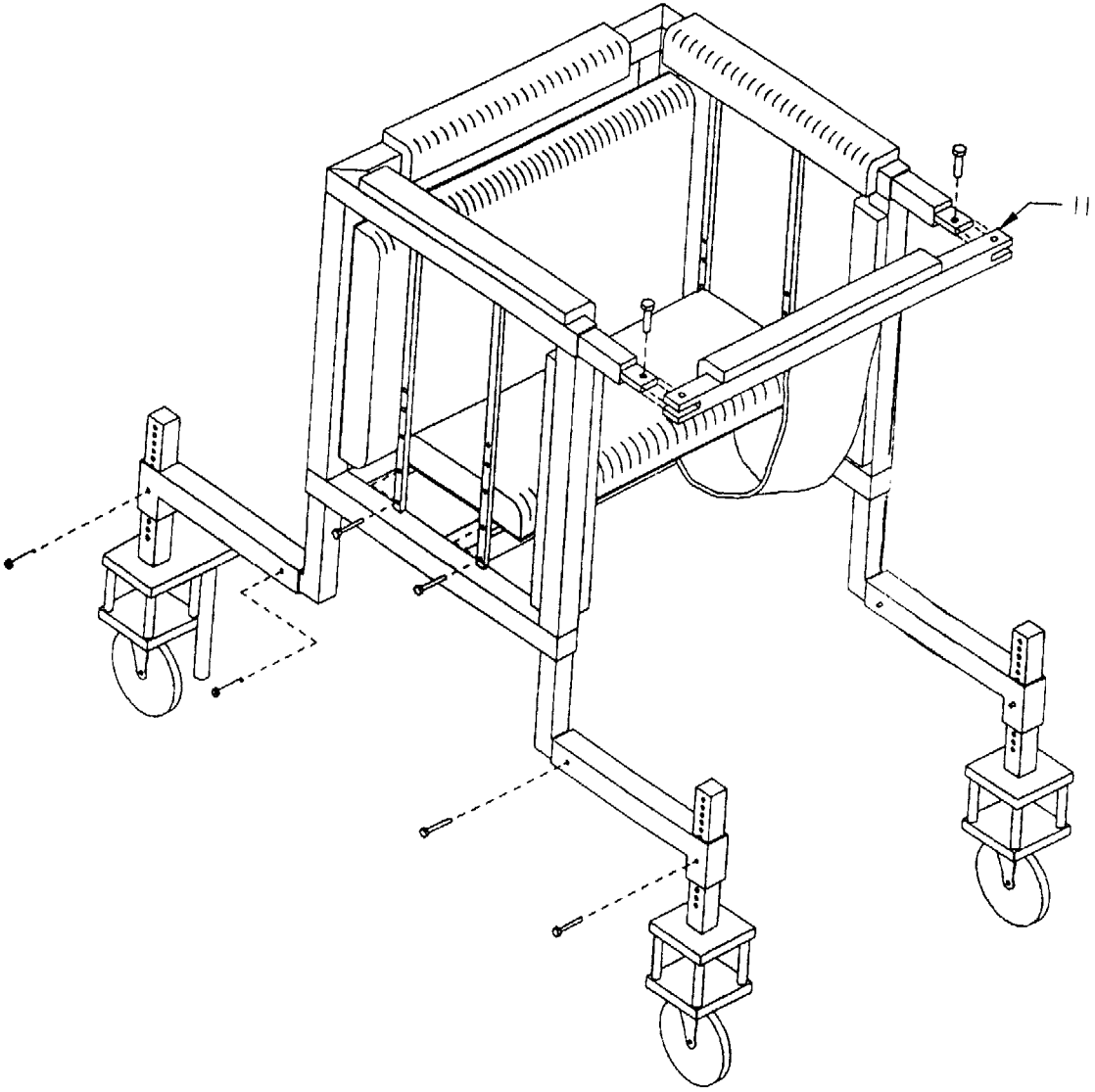
FIG. 4 is an exploded view.
Figure 5:
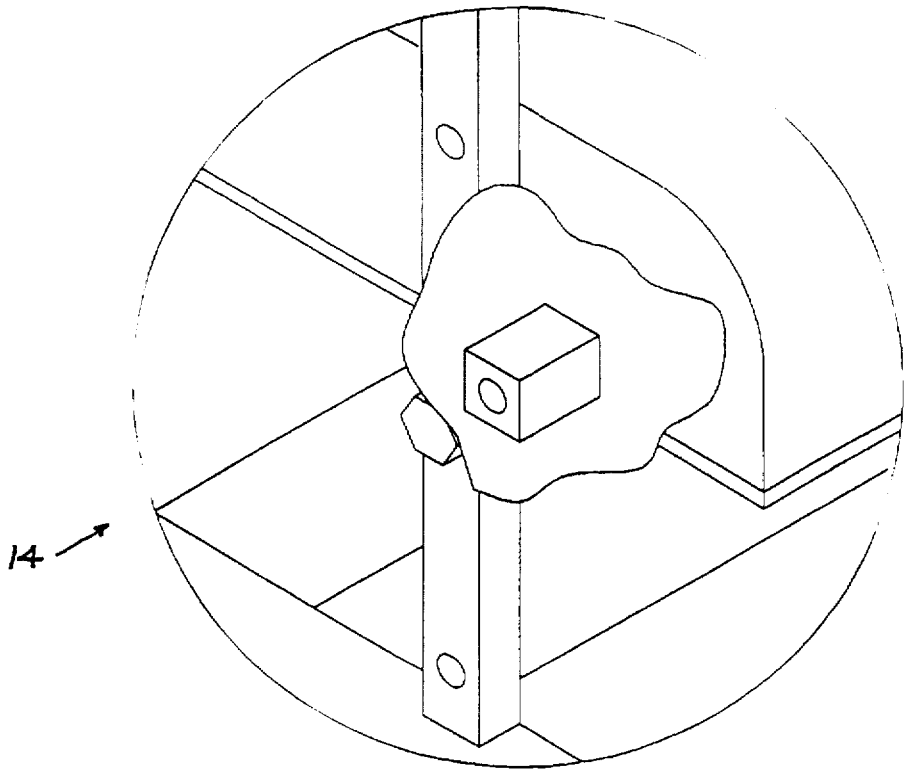
FIG. 5 is a detail view of the adjustable seat.

A seat shown as #11 FIG. 1, also padded, which adjusts up or down by being secured with pins, shown as #14 FIG. 1, to the vertical side posts (two per side), not numbered, but shown in FIGS. 1, 2, and 4. This action is shown in greater detail in FIG. 2.

Four horizontal legs, shown as #9 FIG. 1, each consisting of two sections. The first section shown as #9 FIG. 1 is an "L" shaped piece. The top end is permanently affixed to the bottom side bars of the cage, and is made of solid material. It is perforated with holes aligned in a straight line and running for much of it's bottom length (this is shown in greater detail in FIG. 2).

The second section, shown as #5 FIG. 1, is of hollow tubing, and slides over the bottom length of the first section. It has two holes in it, one at each end. The hole at the end closest to the "elbow" in the first section can align with any of the holes that run along the bottom length of the first section.

The entire horizontal leg unit is adjusted by aligning these holes, as described, and securing with a pin, not numbered but shown in FIGS. 1, 2, and 4.

Four vertical legs, shown as #13 FIG. 1, each made of solid material and perforated with holes aligned in a straight line and running for almost the entire length. Each hole can align with the hole on the end of the horizontal bar into which it fits, and the height of the cage and front bar are adjusted by aligning these holes as desired and securing with a pin, not numbered, but shown in FIGS. 1, 2, 3, and 4.

Four spring loaded pressure sensitive brake platforms, shown as #6 and #7 FIG. 1, each consisting of a top plate, shown as #6 FIG. 1, four spring poles (which compress under pressure from the user's weight), shown as #7 FIG. 1 and permanently affixed to the top and bottom plates, and a bottom plate not marked but shown in FIGS. 1, 2, 3, and 4.

Only rear platforms have brake pegs, shown as #10 FIG. 1, which are permanently affixed to the top plates which are longer in the rear for the purpose of accommodating them.

Four wheels, shown as #8 FIG. 1, each is permanently affixed to the bottom plate of the spring loaded pressure sensitive platform. The front wheels are swivel type. The rear wheels are non-swivel type.

I claim:

1. A walker type exercise device comprising:

(a) four L-shaped square tubing rods, each having an elongated vertical portion and a horizontal extension leg;

(b) four respective wheel units, each comprising: means for height adjustable securement to said extension legs; a shock absorbing unit having a pair of platforms with a plurality of springs therebetween, and a wheel attached to the lowermost platform, and wherein a brake peg is attached to the upper platform of two of said four wheel units and extends downward for positional engagement with a support surface;

(c) three upper and three lower horizontal side rails which interconnect said square rods to form a three sided rectangular enclosure;

(d) a front upper horizontal swing arm connected to said square rods for releasably securing an occupant within said enclosure;

(e) foam padding on said rails; and (f) a height adjustable padded seat attached to said square rods.

* * * * *